US008348083B2

(12) United States Patent
Light

(10) Patent No.: US 8,348,083 B2
(45) Date of Patent: Jan. 8, 2013

(54) PARTITIONED CEREAL BOWL

(76) Inventor: Oded Light, Longmont, CO (US)

( * ) Notice: Subject to any disclaimer, the term of this patent is extended or adjusted under 35 U.S.C. 154(b) by 352 days.

(21) Appl. No.: 12/703,545

(22) Filed: Feb. 10, 2010

(65) Prior Publication Data

US 2010/0200597 A1 Aug. 12, 2010

Related U.S. Application Data

(60) Provisional application No. 61/202,244, filed on Feb. 10, 2009.

(51) Int. Cl.
*B65D 25/08* (2006.01)

(52) U.S. Cl. ..... 220/530; 220/575; 220/529; 220/551

(58) Field of Classification Search ..... 220/575, 220/530, 529, 521, 528, 505, 570, 495.02
See application file for complete search history.

(56) References Cited

U.S. PATENT DOCUMENTS 1,100,298 A * 6/1914 Haas ..... 220/575
1,379,519 A * 5/1921 Bjornsen ..... 220/575
2,170,311 A * 8/1939 Smith ..... 220/575
2,207,417 A * 7/1940 Smith ..... 220/575
2,659,096 A * 11/1953 Mencfeldowski, Jr. .... 15/257.06
2,840,259 A * 6/1958 Steidl ..... 220/563
3,040,897 A * 6/1962 Holman ..... 210/244
3,851,571 A * 12/1974 Nichols ..... 99/450.6
4,874,618 A * 10/1989 Seaborne et al. ..... 426/76
4,884,717 A * 12/1989 Bussard et al. ..... 220/229
4,889,619 A * 12/1989 Lynch ..... 209/374
D305,846 S * 2/1990 Griffith ..... D7/555
4,986,433 A * 1/1991 Davis ..... 220/23.8
5,135,787 A * 8/1992 Bair ..... 428/36.1
5,172,826 A * 12/1992 Celaya ..... 220/574
5,209,348 A * 5/1993 Schafer, III ..... 206/222
5,215,196 A * 6/1993 Valls ..... 209/417
5,242,077 A * 9/1993 Smith et al. ..... 220/529
5,332,102 A * 7/1994 Sennett et al. ..... 209/417
5,341,953 A * 8/1994 Forester ..... 220/575
5,514,394 A * 5/1996 Lenahan ..... 426/120
5,575,848 A * 11/1996 Chedville ..... 118/13
5,676,244 A * 10/1997 Green et al. ..... 206/221
5,676,275 A * 10/1997 Khattar ..... 220/575
5,706,980 A * 1/1998 Dickerson ..... 222/129
5,727,679 A * 3/1998 Newarski ..... 206/222
5,871,116 A * 2/1999 Picchietti ..... 220/501
6,042,858 A * 3/2000 Kairys ..... 426/119
6,047,845 A * 4/2000 Rapaz ..... 220/575
6,264,068 B1 * 7/2001 Ours et al. ..... 222/129
6,378,325 B1 * 4/2002 Yang ..... 62/457.6

(Continued)

*Primary Examiner* — Anthony Stashick
*Assistant Examiner* — Christopher McKinley
(74) *Attorney, Agent, or Firm* — Holland & Hart LLP

(57) ABSTRACT

Methods, systems, and devices are disclosed for partitioning food containers, such as cereal bowls. Some embodiments may include a system with a food container, which may be a cereal bowl. The system may also include a flexible membrane having a top surface and a bottom surface. The membrane may partition the food container into a lower portion and an upper portion. The lower portion may be for holding liquid content. The upper bowl portion may be adapted for holding edible solid content. The membrane may have multiple passageways extending from the membrane bottom surface through the membrane top surface. The multiple passageways may be normally closed and then expand to an open configuration allowing fluid transmission from below the membrane to above the membrane when the membrane is flexed in a first direction normal to a resting plane parallel to the top surface and the bottom surface.

15 Claims, 9 Drawing Sheets

U.S. PATENT DOCUMENTS 6,499,620 B1 * 12/2002 Boguet et al. ..... 220/563
6,656,514 B1 * 12/2003 Tubbs ..... 426/115
7,147,880 B2 * 12/2006 Lenahan ..... 426/115
7,163,102 B2 * 1/2007 Palamara et al. ..... 206/219
7,487,881 B2 * 2/2009 Watzke et al. ..... 220/501
7,591,388 B2 * 9/2009 Amormino ..... 220/229
7,766,168 B2 * 8/2010 Thrapp et al. ..... 206/496
7,784,145 B1 * 8/2010 Prokop ..... 15/257.06
2006/0096990 A1 * 5/2006 Reed ..... 220/507
2007/0068948 A1 * 3/2007 Friedman ..... 220/501

* cited by examiner

PARTITIONED CEREAL BOWL

CROSS-REFERENCES TO RELATED APPLICATIONS

This application is a non-provisional, and claims the benefit, of commonly assigned U.S. Provisional Patent Application No. 61/202,244, filed Feb. 10, 2009, entitled "Partitioned Cereal Bowl," the entirety of which is herein incorporated by reference for all purposes.

BACKGROUND

Embodiments relate to food containers in general and to dishware in particular and more particularly to partitioned food containers, such as partitioned cereal bowls, having a permeable partition for temporarily separating dry and liquid foods.

A main feature of some types of cereal is the crunch and crispiness. This is underscored by cereal manufacturers as a major selling point and is the subject of numerous commercials associated with fun and enjoyment of food. Yet, cereal is usually prepared for serving by topping it with liquids, typically milk. Thus, the cereal absorbs the liquid and becomes soggy, losing its much sought crispiness and crunch. Such an outcome is unavoidable, regardless of how crunchy the cereal originally is, because soaking a grain product in liquid turns it mushy, considering the inherent qualities of the various ingredients.

This is especially evident in people who tend to eat slowly, typically children. The longer the cereal is immersed in liquid, the more soggy and unpalatable it becomes.

It would be desirable to provide a means that may keep the dry food and liquid foods separate until one is ready to eat the food.

BRIEF SUMMARY

Some embodiments may include a partitioned food container system. The partitioned food container system may include a food container. The system may also include a flexible membrane having a top surface and a bottom surface, wherein the membrane partitions the food container into a lower portion and an upper portion, the lower portion being adapted for holding liquid content, the upper bowl portion being adapted for holding edible solid content, the membrane having a plurality of passageways extending from the membrane bottom surface through the membrane top surface.

In some embodiments, a partitioned food container system of claim may include a plurality of passageways that are normally closed and expand to an open configuration allowing fluid transmission from below the membrane to above the membrane when the membrane is flexed in a first direction normal to a resting plane parallel to the top surface and the bottom surface. In some embodiments, a partitioned food container system may include a plurality of passageways that remain in a closed configuration hindering fluid transmission from below the membrane to above the membrane when the membrane is flexed in a second direction normal to the resting plane parallel to the top surface and the bottom surface. In some embodiments, a partitioned food container system may include a plurality of passageways that are normally open.

In some embodiments, a partitioned food container system may include a food container that is a cereal bowl. In some embodiments, a partitioned food container system may include a flexible membrane that is removable from the food container. In some embodiments, a partitioned food container system may include a flexible membrane that is integrated with the food container.

Some embodiments may include a method for partitioning a food container to separate temporarily a liquid from an edible solid content. The method may include inserting a partition into the food container, wherein the partition may have a top surface and a bottom surface. The partition may partition the food container into a lower portion and an upper portion, the lower portion may be adapted for holding liquid content, the upper bowl portion may be adapted for holding edible solid content. The partition may have multiple passageways extending from the partition bottom surface through the partition top surface.

In some embodiments, a method for partitioning a food container to separate temporarily a liquid from an edible solid content may include a partition that includes multiple passageways that are normally closed and expand to an open configuration allowing fluid transmission from below the partition to above the partition when the partition is flexed in a first direction normal to a resting plane parallel to the top surface and the bottom surface. In some embodiments, a method for partitioning a food container to separate temporarily a liquid from an edible solid content may include a partition with multiple passageways that remain in a closed configuration hindering fluid transmission from below the partition to above the partition when the partition is flexed in a second direction normal to the resting plane parallel to the top surface and the bottom surface. In some embodiments, a method for partitioning a food container to separate temporarily a liquid from an edible solid content may include a partition with multiple passageways that are normally open.

In some embodiments, a method for partitioning a food container to separate temporarily a liquid from an edible solid content may include a food container that is a cereal bowl. In some embodiments, a method for partitioning a food container to separate temporarily a liquid from an edible solid content may include a partition that is removable from the food container. In some embodiments, a method for partitioning a food container to separate temporarily a liquid from an edible solid content may include a partition that is integrated with the food container.

Some embodiments may include a food container partition device. The food container partition device may include a membrane having a top surface and a bottom surface. The membrane may partitions a food container into a lower portion and an upper portion. The membrane may have multiple passageways extending from the membrane bottom surface through the membrane top surface.

In some embodiments, a food container partition device of may include a membrane that is further configured to be removably inserted into the food container. In some embodiments, a food container partition device of claim may include a membrane that is further configured to be utilized with the food container that is a cereal bowl. In some embodiments, the membrane may be permanently inserted into a food container.

In some embodiments, a food container partition device may include a partition or membrane that includes multiple passageways that are normally closed and expand to an open configuration allowing fluid transmission from below the membrane to above the membrane when the membrane is flexed in a first direction normal to a resting plane parallel to the top surface and the bottom surface. In some embodiments, a food container partition device may include a partition or membrane with multiple passageways that remain in a closed configuration hindering fluid transmission from below the membrane to above the membrane when the membrane is flexed in a second direction normal to the resting plane parallel to the top surface and the bottom surface. In some embodiments, a food container partition device may include a partition or membrane that includes multiple passageways that are normally open. In some embodiments, a food container partition device may include a support structured coupled with the membrane, wherein the support structure is configured to extend over a top edge of the food container.

In some embodiments, a partitioned cereal bowl may have a partition that keeps solids and liquids separate. Some embodiments may include a disposable partition that can be unitarily constructed with the bowl. In some embodiments, the partition may be separate component, fitting into an existing bowl. The partition may have a lip along peripheral edges to position the partition above the fluid contents of the bowl in some embodiments. A raised knob may allow quick separation of the partition from the bowl extends from the partition. The bowl can be made of various materials. The partition may be made of materials that support a unitarily constructed, flexible, built-in fluid permeable membrane. The membrane may be resiliently flexible, with normally closed micro-passageways so that, under pressure created by a spoon or other utensil, the passageways may open to allow liquid in the bowl to permeate the top side of the membrane, thereby contacting the solid food morsels. The container may be microwavable, disposable, and/or sealed by a peel-off lid. A peel off membrane lid may secure the membrane. In some embodiments, a lid may secure the membrane until microwaving. An air outlet vent may be disposed on the side of the container.

These and other features of different embodiments will become readily apparent upon further review of the following specification and drawings.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Similar reference characters denote corresponding features consistently throughout the attached drawings.

DETAILED DESCRIPTION

This description provides example embodiments, and is not intended to limit the scope, applicability, or configuration of the invention. Rather, the ensuing description of the embodiments will provide those skilled in the art with an enabling description for implementing embodiments of the invention. Various changes may be made in the function and arrangement of elements without departing from the spirit and scope of the invention.

Thus, various embodiments may omit, substitute, or add various procedures or components as appropriate. For instance, it should be appreciated that in alternative embodiments, the methods may be performed in an order different from that described, and that various steps may be added, omitted, or combined. Also, features described with respect to certain embodiments may be combined in various other embodiments. Different aspects and elements of the embodiments may be combined in a similar manner.

It should also be appreciated that the following may individually or collectively be components of a larger system, wherein other procedures may take precedence over or otherwise modify their application. Also, a number of steps may be required before, after, or concurrently with the following embodiments.

Figure 1:
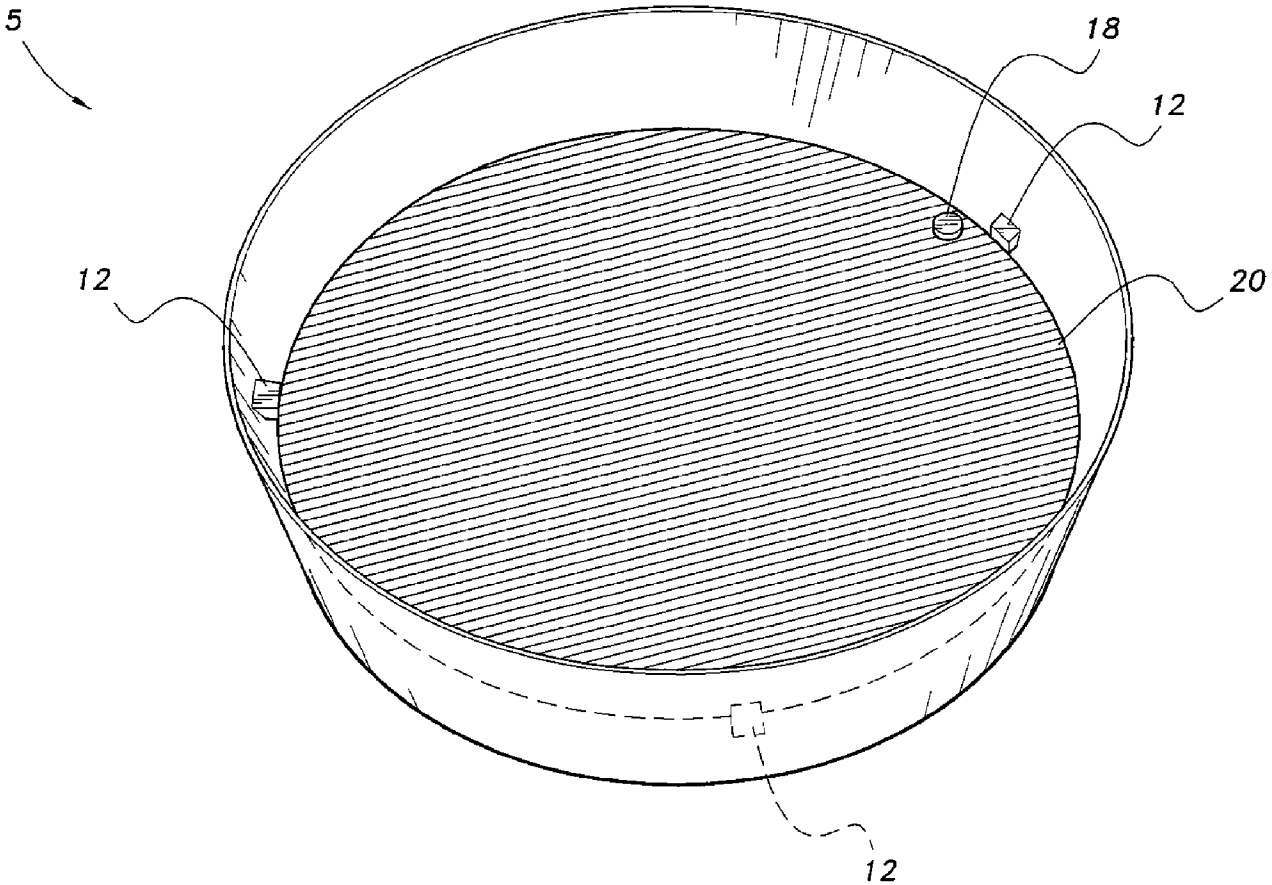
FIG. 1 is an environmental, perspective view of a partitioned food container or system, such as a partitioned cereal bowl, in accordance with various embodiments.
Figure 2:
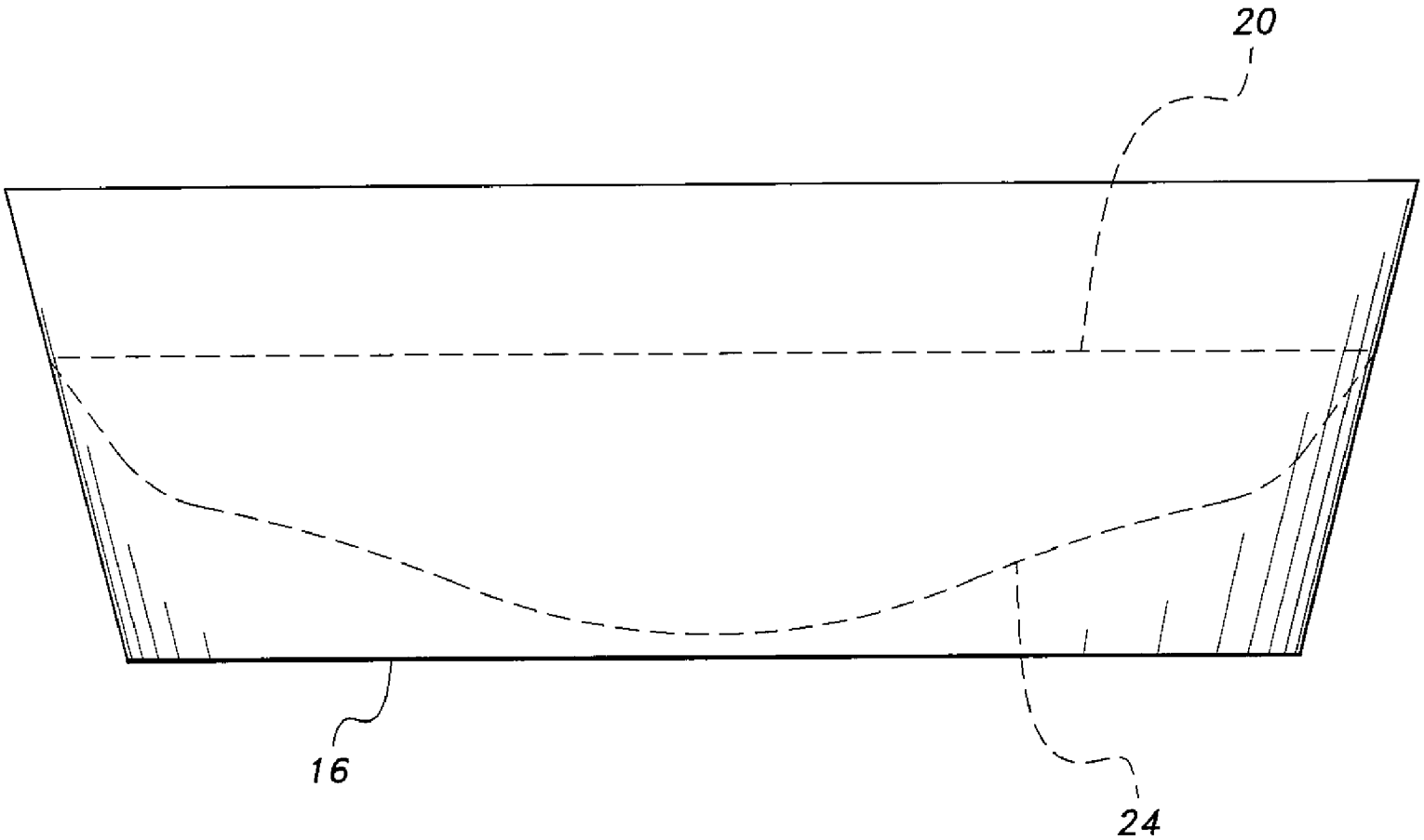
FIG. 2 is a side elevation view of a partitioned food container or system, such as the partitioned cereal bowl of FIG. 1, in accordance with various embodiments.
Figure 3:
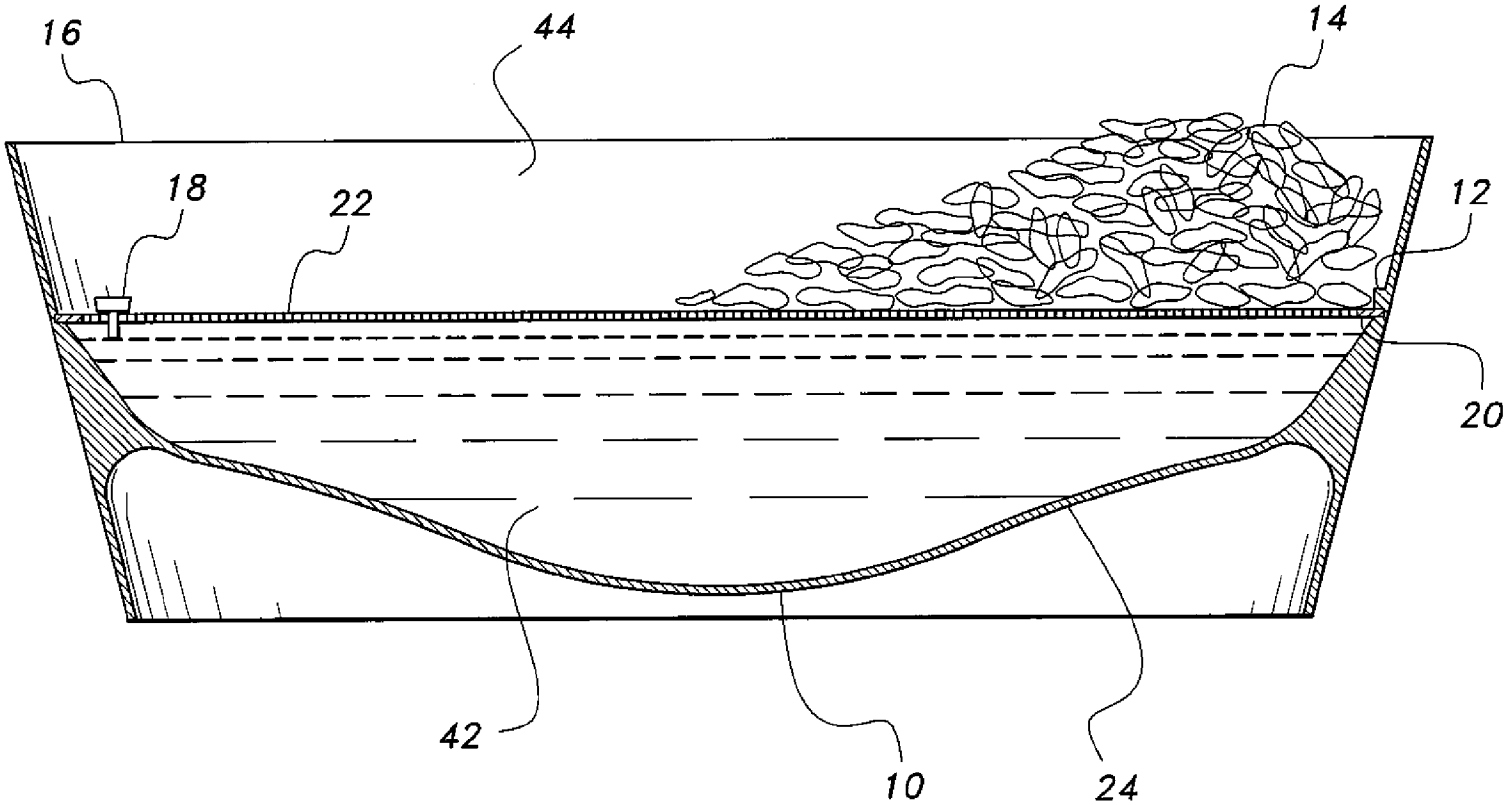
FIG. 3 is a side view in section of a partitioned food container or system, such as the partitioned cereal bowl of FIG. 1, in accordance with various embodiments.

Referring now to FIG. 1, FIG. 2, and/or FIG. 3, embodiments are shown of partitioned food containers, devices, and/or systems such as a partitioned cereal bowl, merely by way of example. Embodiments of partitioned food containers, devices, and/or systems may keep solids (i.e., cereal) and liquids (i.e., milk) separate until it may be desired to eat the solids, such as a cereal. In some embodiments, partition 20 may be integral to a food container, such as bowl 16. In some embodiment, partition 20 may be disposable. In some embodiments, partition 20 may be supported by mounting tabs 12.

Figure 10:
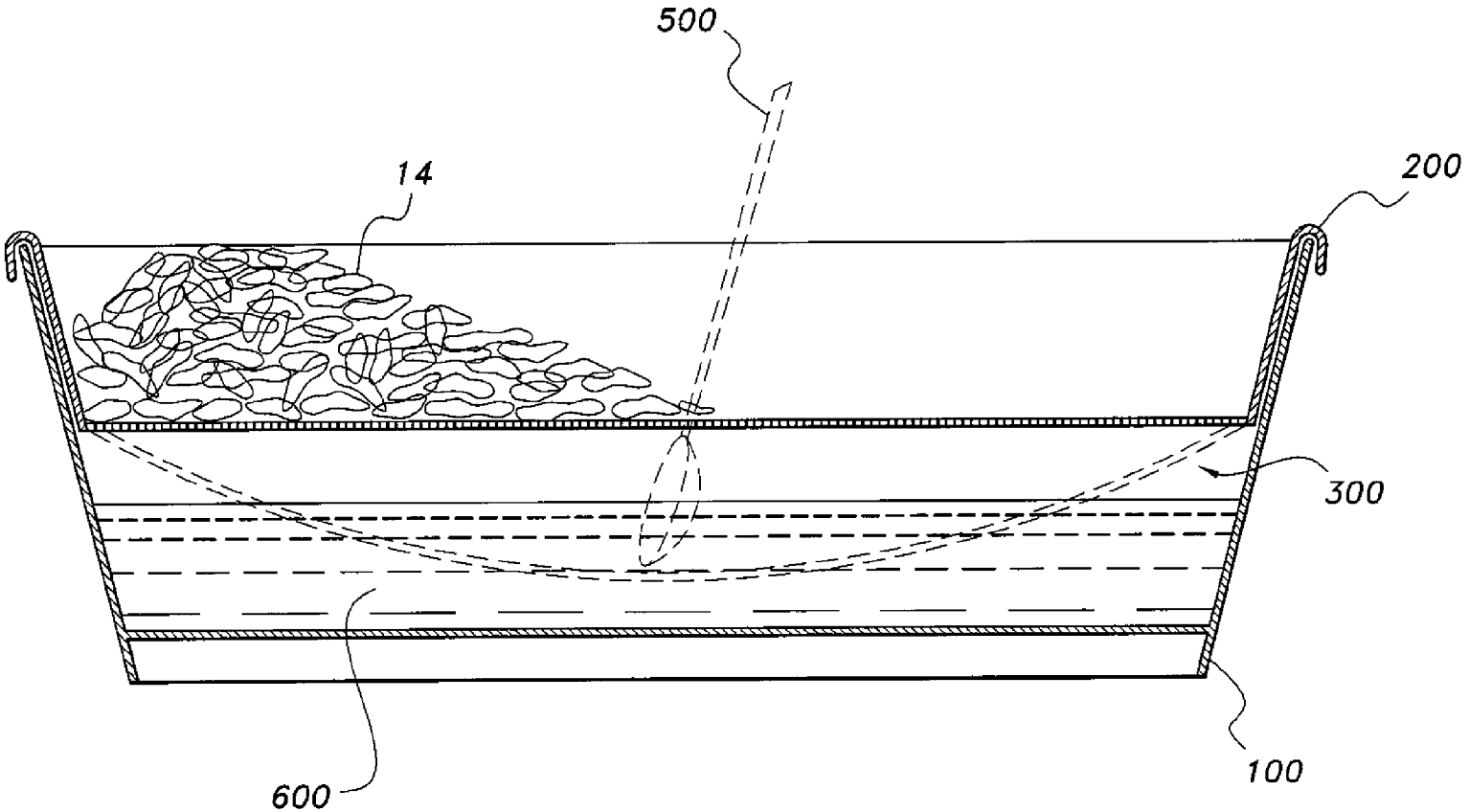
FIG. 10 is a side view of another alternative embodiment of a partitioned food container or system, such as a partitioned cereal bowl, in accordance with various embodiments.

In some embodiments, partition 20 may be separable to retrofit an existing food container, such as an ordinary cereal bowl. Embodiments may include a partition that may have an edge or lip 200 (as shown in FIG. 10, merely by way of example) that may allow the partition to sit a predetermined distance above the fluid-containing portion of the food container. In some embodiments, raised knob 18, which may allow quick separation of the partition from the food container, such as a bowl, extends from partition 20.

Food container 16, which may be a bowl or more particularly a cereal bowl, can be made of various materials. Merely by way of example, food container 16 may be made of materials including, but not limited to, disposable plasticized materials, cardboard, paper, or the like. Partition 20 may be made of different materials, such as stretchable nylon, that can readily accommodate a flexible, built-in membrane 22, merely by way of example. In some embodiments, membrane 22 may be made of natural and/or synthetic materials. Merely by way of example, membrane 22 may be made of stretchable nylon and/or rubber.

As shown in FIG. 2, the fluid-containing portion of the food container 16 may be defined by the volume between inner bottom 24 of food container 16 and partition 20 for some embodiments.

As shown in FIG. 3, the inside bottom portion of food container 16 may have a substantially concave contour 10 for some embodiments.

Figure 6:
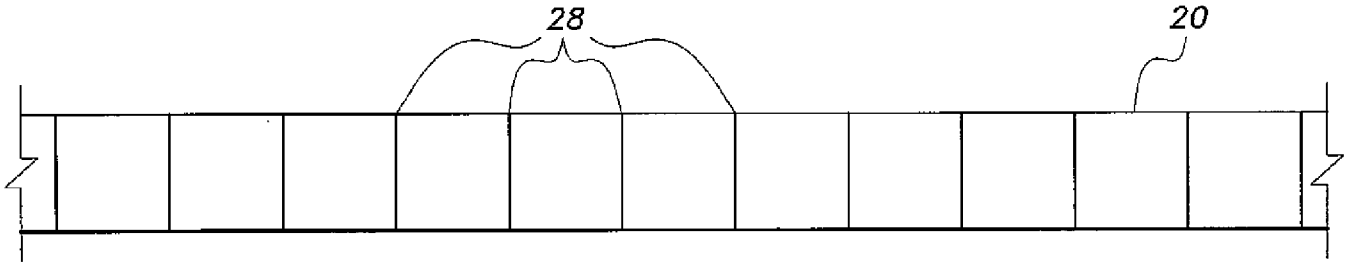
FIG. 6 is a partial side view in section of a membrane for a partitioned food container or system, such as a partitioned cereal bowl, in accordance with various embodiments, the passages through the membrane being closed.
Figure 7:
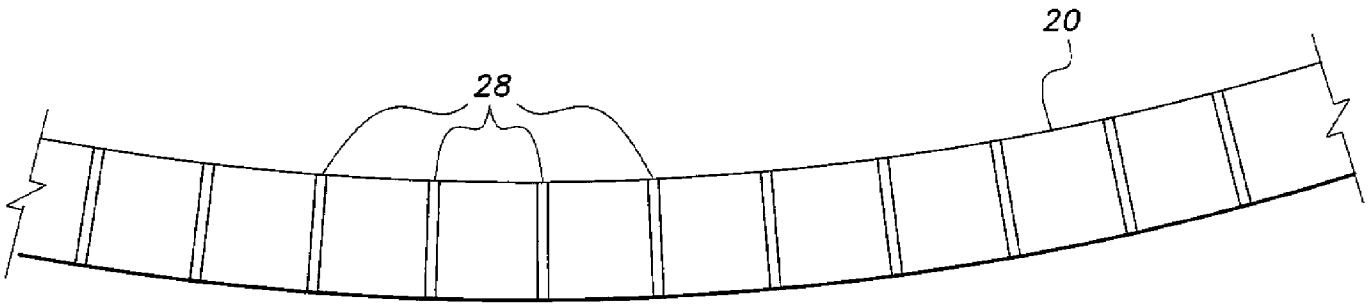
FIG. 7 is a partial side view in section of a membrane for a partitioned food container or system, such as a partitioned cereal bowl, in accordance with various embodiments, the passages through the membrane being open by distension of the membrane to allow the passage of liquid through the membrane.

As shown in FIG. 6 and/or FIG. 7, membrane 22 may be flexible with normally closed passages 28 through its upper and lower surfaces for some embodiments. In some embodiments, membrane 22 may include openings that are normally open, such as with a mesh structure, merely by way of example. Membrane 22 may be resilient and flexible, passages 28 opening under pressure caused by a spoon or the like, thus letting liquid seep through the opened passageways.

Figure 8:
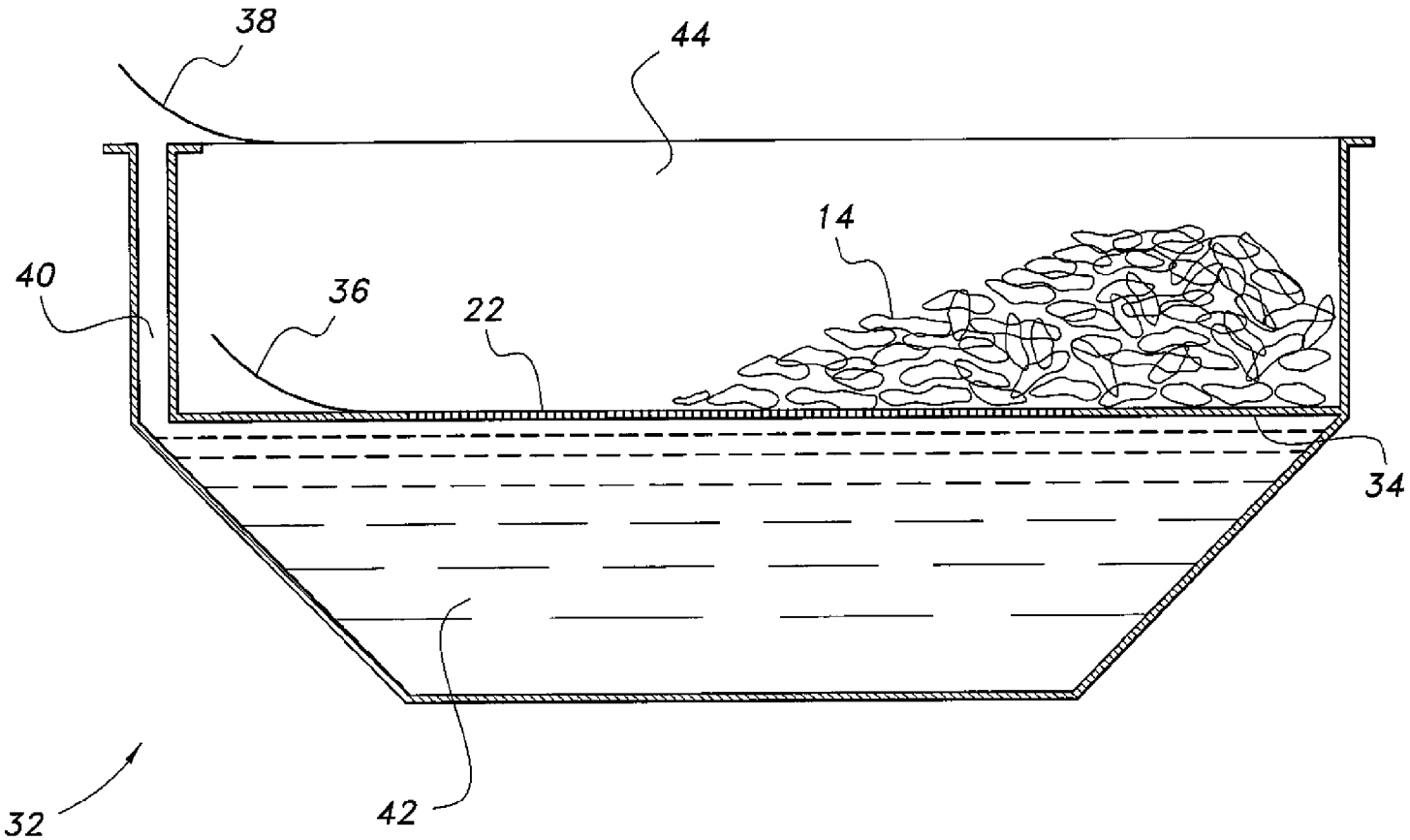
FIG. 8 is a side view in section of an alternative embodiment of a partitioned food container or system, such as a partitioned cereal bowl, in accordance with various embodiments.
Figure 9:
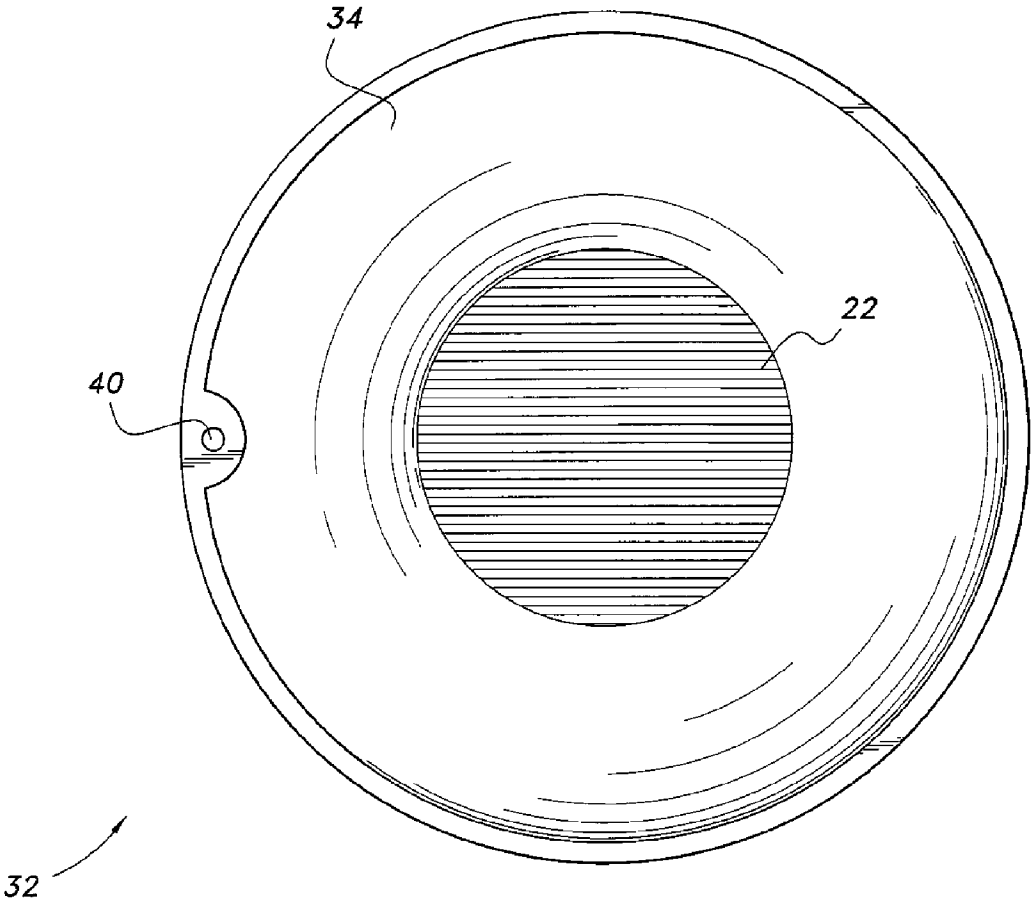
FIG. 9 is a top view of a partitioned food container or system, such as partitioned cereal bowl of FIG. 8, in accordance with various embodiments.

As shown in FIG. 8 and/or FIG. 9, embodiments of a partitioned food container, devices, and/or systems such as a partitioned cereal bowl may comprise a microwavable and/or disposable bowl 32. Some embodiments may include container lid 38, which may be a peel-off container lid, that may seal the container or bowl 32, which has upper section 44 holding solid food, such as cereal flakes 14 and lower section 42 capable of holding liquid, bowl 32 being divided by a disposable container partition 34 comprised of flexible membrane 22 and any required membrane supporting structure to define the sections 42 and 44. In some embodiments, a peel-off membrane lid or release paper 36 may secure membrane 22 until microwaving. Hollow vent 40 on the side of bowl 32 may provide an air outlet.

Figure 4:
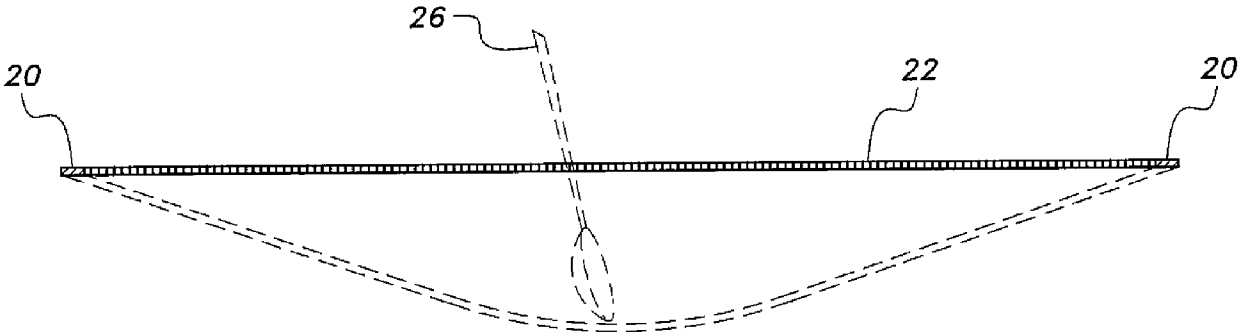
FIG. 4 is a side view in section of a membrane for a partitioned food container or system, such as a partitioned cereal bowl, in accordance with various embodiments.
Figure 5:
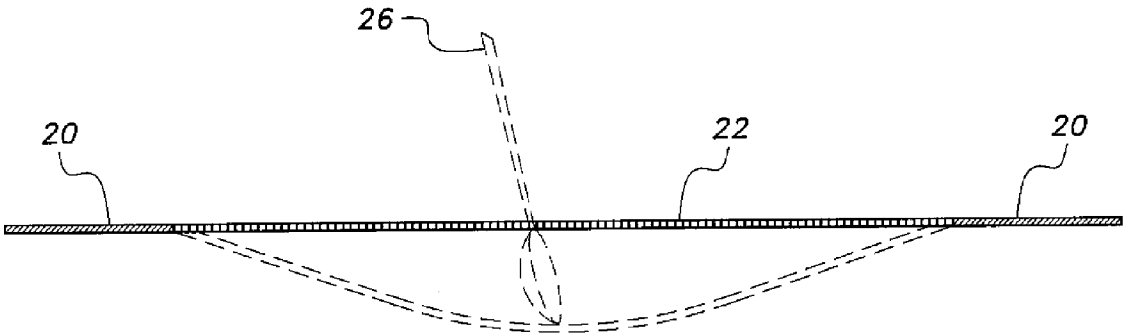
FIG. 5 is a side view in section of an alternative embodiment of a membrane for a partitioned food container or system, such as a partitioned cereal bowl, in accordance with various embodiments.

As shown in FIG. 4 and/or FIG. 5, some embodiments may include a supporting structure of partition 20 that can be of varying annular thickness, depending upon the particular design of food container and membrane 22.

Figure 11:
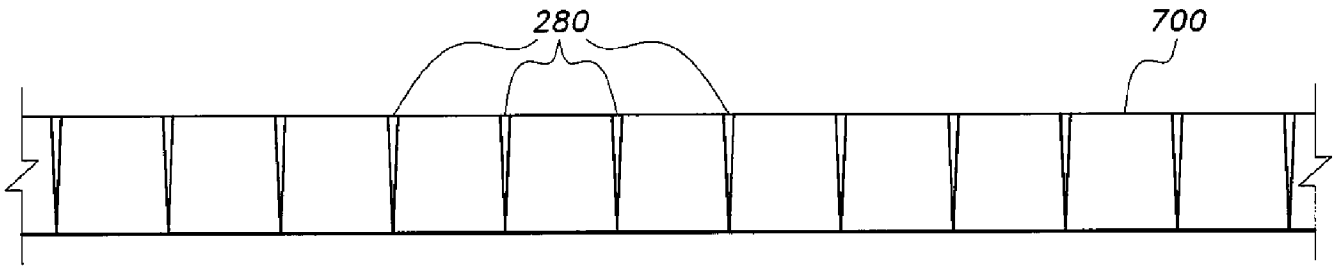
FIG. 11 is a partial side view in section view of an alternative embodiment of a closed membrane for a partitioned food container or system, such as a partitioned cereal bowl, in accordance with various embodiments.
Figure 12:
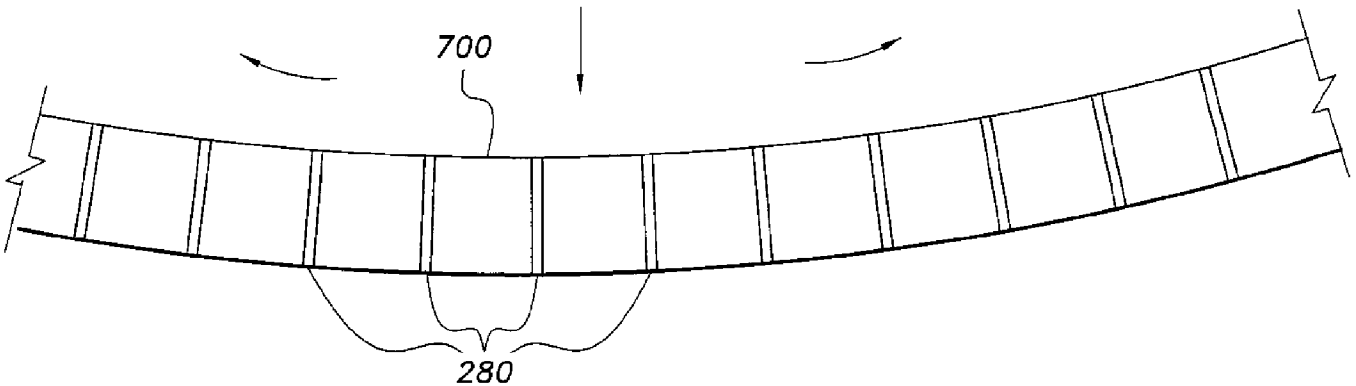
FIG. 12 is a partial side view in section view of an alternative embodiment of an open membrane for a partitioned food container or system, such as a partitioned cereal bowl, in accordance with various embodiments.

As shown in FIG. 10, FIG. 11, and/or FIG. 12, some embodiments of food container 100, such as a bowl, may have permeable membrane 700 with membrane passageways 280 that open in when membrane 700 is pushed in particular directions. In some embodiments, membrane passageways 280 may open in one normal direction, as shown. In some embodiments, spoon 500 or the like may be dipped into the interior of food container 100, causing membrane flexion 300, which introduces fluid from fluid holding portion 600 to commingle with a portion of solid food 14, such as cereal. In some embodiments, membrane partition 700 may have V-shaped passageways 280 that are closed when the membrane 700 is disposed across the bowl at rest, i.e., with no normal flexion applied. When a downward normal force is applied to membrane 700, V-shaped passageways 280 may be stretched open at the bottom, thereby opening passageways 280 for transmission of fluid between lower and upper membrane surfaces. In some embodiments, when the normal force is applied from the opposite direction, e.g., if the bowl is turned upside down, the apex portion just gets tighter, thereby continuing to seal off the fluid portion of the bowl.

In some embodiments, the manner of using a partitioned food container, devices, and/or systems, such as a partitioned cereal bowl, may be described as follows. A user may pour some liquid (milk for example) into bowl 16, which washes off the slanted inner bottom, merely by way of example, creating a reservoir in and around concave bowl portion 10. Partition 20 may be placed onto upper peripheral portion of bowl 16. Such placement may occur in a variety of ways, including, but not limited to, being snapped in to place, screwed in to place, and/or flexed in to place. Solid food section 44, such as a cereal flake section, may thus be created at top portion of bowl 16. In some embodiments, an opening may be provided so that a liquid may be introduced into a lower portion of a food container such that that partition 20 may be in place when the liquid is poured into bowl 16. In some embodiments, liquid may be poured onto partition 20 and it may pass through to a lower portion of bowl 16; in some embodiments, this method may involving flexing partition 20 so that the liquid may pass to the lower portion.

Solid food section 44, such as a cereal flake section, may be filled with solid food 14, such as dry cereal flakes. While taking a spoonful of flakes 14, merely by way of example, spoon 26 or other like utensil or comparable means (such as using one's fingers) may be pressed vertically down against flexible membrane 22, forcing membrane 22 to bend and membrane passageways 30 to open. Spoon 26 or the like, loaded with cereal 14, may be immersed, possibly briefly, into liquid (milk) reservoir 42 and lifted, possibly immediately, thereby releasing the pressure of membrane 22, closing passages 30 and keeping the remaining bulk of unused flakes 14 separate from the liquid (milk) section 42. Hence, in some embodiments, one can repeatedly enjoy numerous spoonfuls of dry and crunchy cereal with liquid (milk) using the same dishware, regardless of whether both ingredients have been placed in it. Using knob 18, partition 20 can be removed from the bowl 16 and cleaned.

In some embodiments, disposable microwavable container 32 may operate similarly with peel-off lid 38 and peel-off membrane lid 36.

It is to be understood that the present invention is not limited to the embodiments described above, but encompasses any and all embodiments within the scope of the following claims.

It should also be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various steps may be added, omitted, or combined. Also, features described with respect to certain embodiments may be combined in various other embodiments.

Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details.

For example, processes, structures, and techniques have been shown without unnecessary detail in order to avoid obscuring the embodiments.

Also, it is noted that the embodiments may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A partitioned food container system, comprising:

a food container; and a flexible membrane having a top surface and a bottom surface, wherein the membrane partitions the food container into a lower portion and an upper portion, the lower portion being adapted for holding liquid content, the upper portion being adapted for holding edible solid content, the membrane having a plurality of passageways extending from the membrane bottom surface through the membrane top surface, wherein the plurality of passageways are normally closed and expand to an open configuration allowing fluid transmission from below the membrane to above the membrane when the membrane is flexed in a first direction normal to a resting plane parallel to the top surface and the bottom surface and the plurality of passageways remain in a closed configuration hindering fluid transmission from below the membrane to above the membrane when the membrane is flexed in a second direction normal to the resting plane parallel to the top surface and the bottom surface.

2. The partitioned food container system of claim 1, wherein the plurality of passageways are normally open.

3. The partitioned food container system of claim 1, wherein the food container is a cereal bowl.

4. The partitioned food container system of claim 1, wherein the flexible membrane is removable from the food container.

5. The partitioned food container system of claim 1, wherein the flexible membrane is integrated with the food container.

6. A method for partitioning a food container to separate temporarily a liquid from an edible solid content, the method comprising:

inserting a partition into the food container, wherein the partition includes a top surface and a bottom surface and the partition partitions the food container into a lower portion and an upper portion, the lower portion being adapted for holding liquid content, the upper portion being adapted for holding edible solid content, the partition having a plurality of passageways extending from the partition bottom surface through the partition top surface, wherein the plurality of passageways are normally closed and expand to an open configuration allowing fluid transmission from below the partition to above the partition when the partition is flexed in a first direction normal to a resting plane parallel to the top surface and the bottom surface and the plurality of passageways remain in a closed configuration hindering fluid transmission from below the partition to above the partition when the partition is flexed in a second direction normal to the resting plane parallel to the top surface and the bottom surface.

7. The method for partitioning a food container to separate temporarily a liquid from an edible solid content of claim 6, wherein the plurality of passageways are normally open.

8. The method for partitioning a food container to separate temporarily a liquid from an edible solid content of claim 6, wherein the food container is a cereal bowl.

9. The method for partitioning a food container to separate temporarily a liquid from an edible solid content of claim 6, wherein the partition is removable from the food container.

10. The method for partitioning a food container to separate temporarily a liquid from an edible solid content of claim 6, wherein the partition is integrated with the food container.

11. A food container partition device comprising:

a membrane having a top surface and a bottom surface, wherein the membrane partitions a food container into a lower portion and an upper portion, the membrane having a plurality of passageways extending from the membrane bottom surface through the membrane top surface, wherein the plurality of passageways are normally closed and expand to an open configuration allowing fluid transmission from below the membrane to above the membrane when the membrane is flexed in a first direction normal to a resting plane parallel to the top surface and the bottom surface and the plurality of passageways remain in a closed configuration hindering fluid transmission from below the membrane to above the membrane when the membrane is flexed in a second direction normal to the resting plane parallel to the top surface and the bottom surface.

12. The food container partition device of claim 11, wherein the membrane is further configured to be removably inserted into the food container.

13. The food container partition device of claim 11, wherein the membrane is further configured to be utilized with the food container that is a cereal bowl.

14. The food container partition device of claim 11, wherein the plurality of passageways are normally open.

15. The food container partition device of claim 11, further comprising a support structure coupled with the membrane, wherein the support structure is configured to extend over a top edge of the food container.

* * * * *